United States Patent [19]

Kistner

[11] Patent Number: 5,005,982

[45] Date of Patent: Apr. 9, 1991

[54] MATERIAL PROCESSOR

[76] Inventor: Kenneth J. Kistner, 419 Tahoe La., Midlothian, Tex. 76065

[21] Appl. No.: 369,108

[22] Filed: Jun. 21, 1989

[51] Int. Cl.[5] ..... B01F 5/14

[52] U.S. Cl. ..... 366/272; 366/262; 418/127; 418/196; 418/20

[58] Field of Search ..... 366/272, 97, 91, 262, 366/176, 190; 418/127, 196, 19, 20

[56] References Cited

U.S. PATENT DOCUMENTS

| | | | |
|---|---|---|---|
| 2,116,380 | 5/1938 | Bauer | 259/41 |
| 2,272,309 | 2/1942 | Mott | 418/196 |
| 2,474,254 | 6/1949 | Kaufman | 366/272 |
| 2,502,563 | 4/1950 | Goodchild | 259/104 |
| 2,880,455 | 4/1959 | Mineah | 18/2 |
| 3,142,476 | 7/1964 | Goodwin | 259/6 |
| 3,152,792 | 10/1964 | Goodwin | 366/272 |
| 3,229,911 | 1/1966 | Carlson | 239/142 |
| 3,266,430 | 8/1966 | Mylo | 418/196 |
| 3,349,713 | 10/1967 | Fassbender | 103/6 |
| 3,558,282 | 1/1971 | Evans | 23/285 |
| 4,015,828 | 4/1977 | Miles | 259/6 |
| 4,514,090 | 4/1985 | Neubauer | 366/91 |
| 4,605,309 | 8/1986 | Albers | 366/76 |

*Primary Examiner*—Robert W. Jenkins

*Attorney, Agent, or Firm*—Richards, Medlock & Andrews

[57] ABSTRACT

A material processor for processing materials to improve their rheological and material properties includes a housing defining a process chamber and having an inlet for introducing materials therein and an outlet for discharging materials therefrom. Intermeshing gears are rotatably positioned in the process chamber and define an area of intermesh which is positioned in the flow path between the inlet and the outlet of the process chamber. A power source is provided for rotating one or both of the intermeshing gears. The mesh between the gears is such that during rotation, a clearance exists therebetween permitting a path between the gears such that material may flow from the discharge side to the inlet side of the gears through the intermesh and be subjected to extreme pressures, localized heating, shear and cavitation effects resulting in the processing of the materials.

29 Claims, 4 Drawing Sheets

MATERIAL PROCESSOR

TECHNICAL FIELD

The present invention relates to apparatus for material processing, reprocessing, or mixing of two or more components. More particularly, the invention relates to a system for improving the rheological and material properties of fluids and semi-fluids, for liquefying solids or for mixing material components by subjecting such materials to extreme pressures, localized heating, shearing and cavitation effects.

BACKGROUND OF THE INVENTION

It is well-known in the art to mix two or more materials to form a uniform flowable liquid. One prior art apparatus for accomplishing such mixing, shown in the patent to S. L. Goodchild, U.S. Pat No. 2,502,563, uses two oppositely rotating intermeshed rotors acting in a chamber wherein the materials being mixed are pumped into the chamber and allowed to flow laterally along the length of the rotors as they are mixed. Another mixing technique, shown in the patent to C.H. Goodwin, U.S. Pat. No. 3,142,476, incorporates a large sun gear surrounded by a series of planetary gears which intermesh with and rotate upon rotation of the sun gear. The fluid is mixed by movement past the plurality of sun gears and their engagement with the planetary gear, such movement being counter to the movement of the teeth of the sun gear.

Another mixing apparatus is shown in the patent to S.G. Bauer, U.S. Pat. No. 2,116,380, wherein a gear pump is constructed with sufficient clearance between the casing and the teeth of the gears to provide a definite leakage path for the material under treatment from the outlet end toward the inlet end of the pump with a exhaust valve designed to ensure return flow of a substantial portion of the mass along the leakage path. Such pump provides for the recirculation of fluid between the teeth of the gears and the casing to effect mixing of the liquids.

A material mixing and treating apparatus is shown in the patent to A. Albers, U.S. Pat. No. 4,605,309, wherein a roller mill with the two rotatable rollers of a roller mill rotate at different speeds relative to one another. The external surfaces of the rollers have grooved portions with the transition regions between such surface in each such groove being sharp-edged. The grooves are inclinedly disposed at an acute angle relative to the roll axis with the grooves on the first roll having an opposite hand to the grooves on the second roll. The material enters at one end of the rollers and is discharged at the opposite end after having traversed a path along the longitudinal axis of the rolls. The material is subjected to a saw-like or chopping action resulting in an intense shearing heat being produced.

Although these prior devices have accomplished their objective, that is, the mixing of two or more fluid components, the apparatus shown in the patents to Bauer, Goodchild, and Goodwin are not designed to materially alter the components being mixed and therefore do not improve the rheological or physical properties of the material. The apparatus shown in the patent to Albers, while designed to effect material shearing, accomplishes such shearing only by having spiral grooves which must form sharp edges for effecting such shearing action and by the rotation of the rolls at different speeds.

Thus, a need exists, and has existed for a substantial time, for a processing apparatus which not only mixes material, but improves the rheological and material properties, without the need to add heat to the system or to materially increase the temperature of the bulk fluids being processed.

DISCLOSURE OF THE INVENTION

The invention relates to a material processor for processing materials to improve their rheological and material properties. The processor includes a housing defining a process chamber and having an inlet for introducing material therein and an outlet for discharging material therefrom. Intermeshing gears are rotatably positioned in the process chamber, and define an area of intermesh which is positioned in the flow path between the inlet and the outlet of the process chamber. A power source is provided for rotating one or both of the intermeshing gears. The mesh between the gears is such that during rotation, a clearance exists therebetween permitting a path between the gears such that material may flow from the discharge side to the inlet side of the gears through the intermesh.

In one embodiment of the invention, the intermeshing gears include a drive process gear and a driven process gear in intermeshing relation. The power source drives the drive gear and a clearance is provided between the drive and driven gears such that at relatively slow speeds, for example 200 rpm, the driven gear is forced ahead of and out of contact with the drive gear by the processed material which is permitted to flow therebetween. However, the gears have intermeshing teeth such that although fluid may flow therebetween, it is subjected to extremely high mechanical forces.

Thus, in the normal operation of the present invention, material is introduced into the inlet and carried by the counter-rotation of the intermeshing gears along a path between the teeth of the gears and the process chamber walls. This flow path communicates with the discharge outlet. However, because of the lash or clearance which is provided between the intermeshing gears, and due to viscous coupling between the material and the gears, a substantial portion of the material passes through the intermesh rather than being discharged through the outlet. This movement of the material through the intermesh zone is a result of viscous coupling between the material and the gears. The material is, therefore, trapped between the intermeshing gears and is subjected to substantial compression, shear forces and cavitation. Thus, unlike a normally operating gear pump, the process gears of the present invention do not form a contacting seal at the point of intermesh but rather one gear floats ahead of the other with a thin layer of the material being positioned therebetween.

In accordance with another embodiment of the invention, the clearances between the gear teeth and the housing adjacent the inlet are greater than the clearances between the gear teeth and the housing adjacent the outlet. In this way, material which is carried from the inlet to the discharge area is subjected to additional compression forces which result in the breakdown of larger aggregate masses, material mixing and shearing.

In accordance with another embodiment of the invention, one or more adjustable shoe sections form a part of the sidewall of the process chamber. Each adjustable shoe section is moveable toward and away from one of the process gears and a control structure is provided to effect such movement. By adjusting the position of each shoe section, the clearance between the gear and the portion of the process chamber formed by the adjustable shoe section may be regulated for the purpose of facilitating the processing of material.

In accordance with a further embodiment of the invention, one or more spur gears is supported within the housing and positioned in intermeshing relation with one or more of the process gears. This forms a pair of additional intermesh zones in the flow paths of the material as it is moved from the inlet around the process gears, to the discharge. These gears, and their interaction with the process gears add further mixing and material disruption to facilitate the processing of the material.

In accordance with still a further embodiment of the invention, the control structure for adjusting the position of the spur gear in relation to the process gear includes hydraulic controls which are designed to respond to larger components of material being introduced into the system. For example, where large chunks of material are introduced with fluids, the spur gear may move away from the process gear while still applying sufficient crushing force to reduce the size of such material for further processing. During this cycling process, these larger components are broken down as small, solid aggregate masses suspended in the fluids.

In still a further embodiment of the invention, the material processor includes a housing defining a process chamber having one or more inlets for introducing material therein and at least one outlet for discharging material therefrom. Two sets of intermeshing rotatable gears are positioned in the process chamber. Either one or both of the gears in each pair are driven by a power source. Each pair of gears has a relatively close intermeshing relationship which prevents the flow of material therebetween and one of each gear in each pair is in loose intermeshing engagement with one of the gears of the other pair. The loose intermeshing relationship permits the flow of material therebetween. The inlet is separated from the outlet by at least one loose mesh engagement and one close mesh engagement.

In normal operation, single or multiple materials are loaded into the process chamber through the inlet and pass around the first pair of gears between the gear teeth and the process chamber wall. The material or materials are then directed through the loose mesh engagement between the first pair of gears the second pair of gears. After passing through such loose mesh engagement, the materials are exhausted through the discharge.

In one embodiment of the invention, the loose mesh engagement described in embodiments disclosed, means an engagement wherein a clearance of from 0.0015 to 0.003 in. (0.038 to 0.076 mm.).

BRIEF DESCRIPTION OF THE DRAWINGS

For a more complete understanding of the present invention, and for further details and advantages thereof, reference is now made to the following Detailed Description of the Preferred Embodiments taken in conjunction with the accompanying drawings, in which.

DESCRIPTION OF THE PREFERRED EMBODIMENTS

Figure 1:
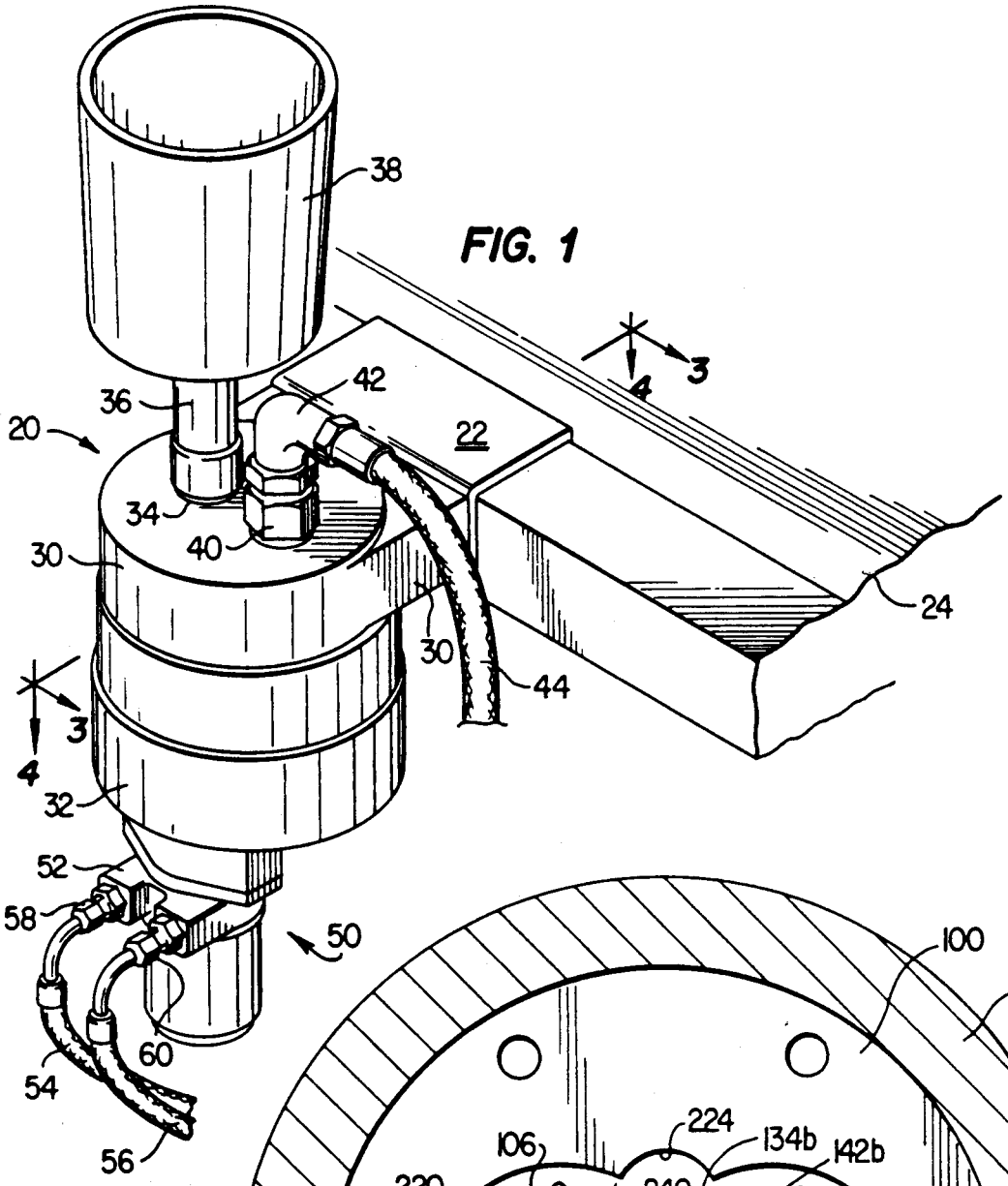
FIG. 1 is a perspective view of the material processing apparatus of the present invention.

Referring now to the figures, FIG. 1 is a perspective view of a material processor 20 according to the present invention mounted by a support frame extension 22 to a support structure 24. Material processor 20 includes an upper housing 30 supported from support frame extension 22 and a lower housing 32 which is attached to upper housing 30. Upper housing 30 has an inlet 34 which receives an inlet pipe 36 for feeding material from a material hopper 38 into the processor. A discharge fitting 40 is also mounted on upper housing 30 and is attached by an elbow fitting 42 to fluid discharge line 44. A hydraulic drive or torque motor assembly 50 is attached to the lower side of lower housing 32 and includes a manifold 52 which receives a hydraulic input line 54 and a hydraulic exhaust 56. Lines 54 and 56 are attached to manifold 52 by appropriate fittings 58 and 60, respectively.

Figure 2:
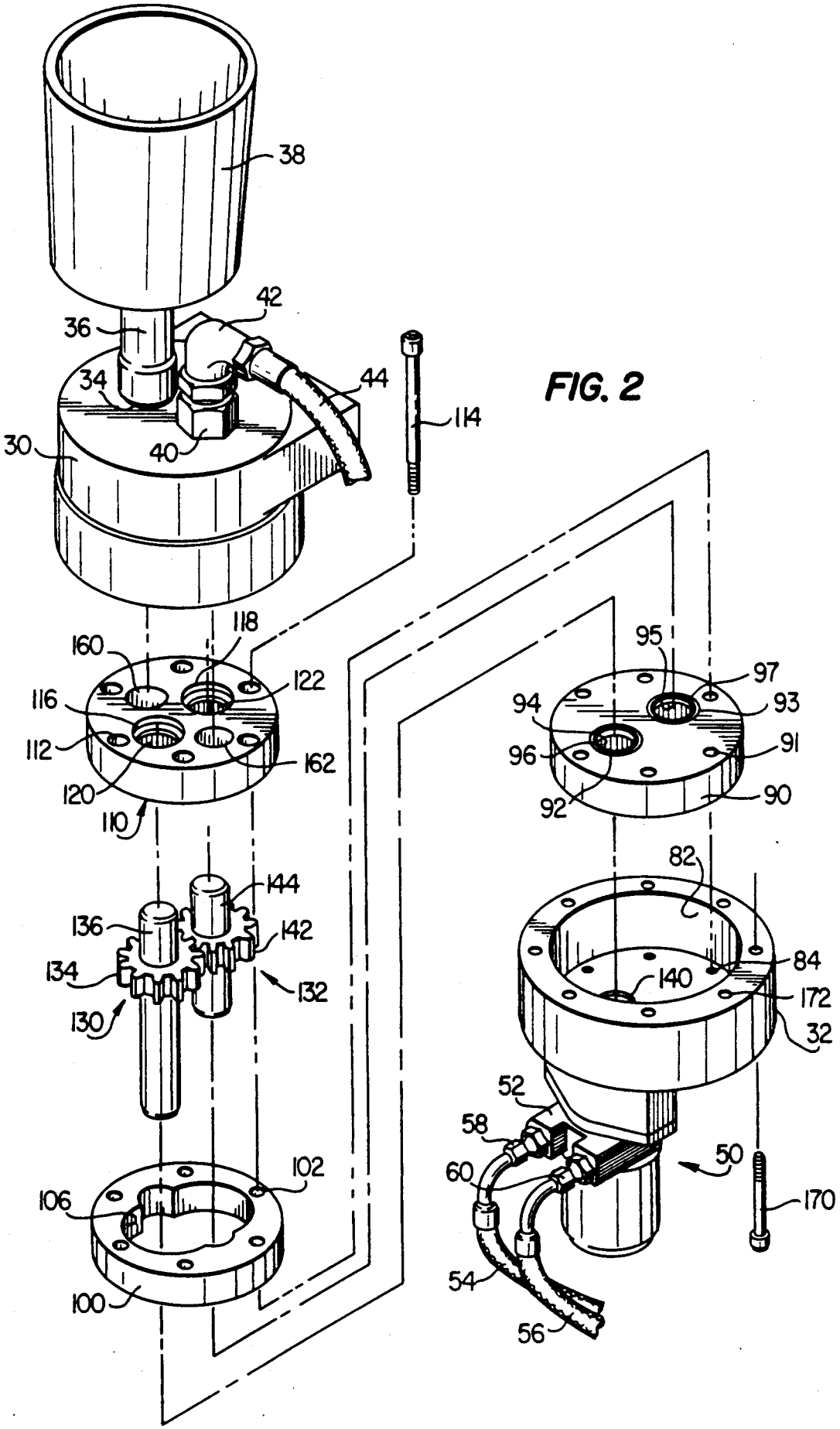
FIG. 2 is an exploded view thereof.
Figure 3:
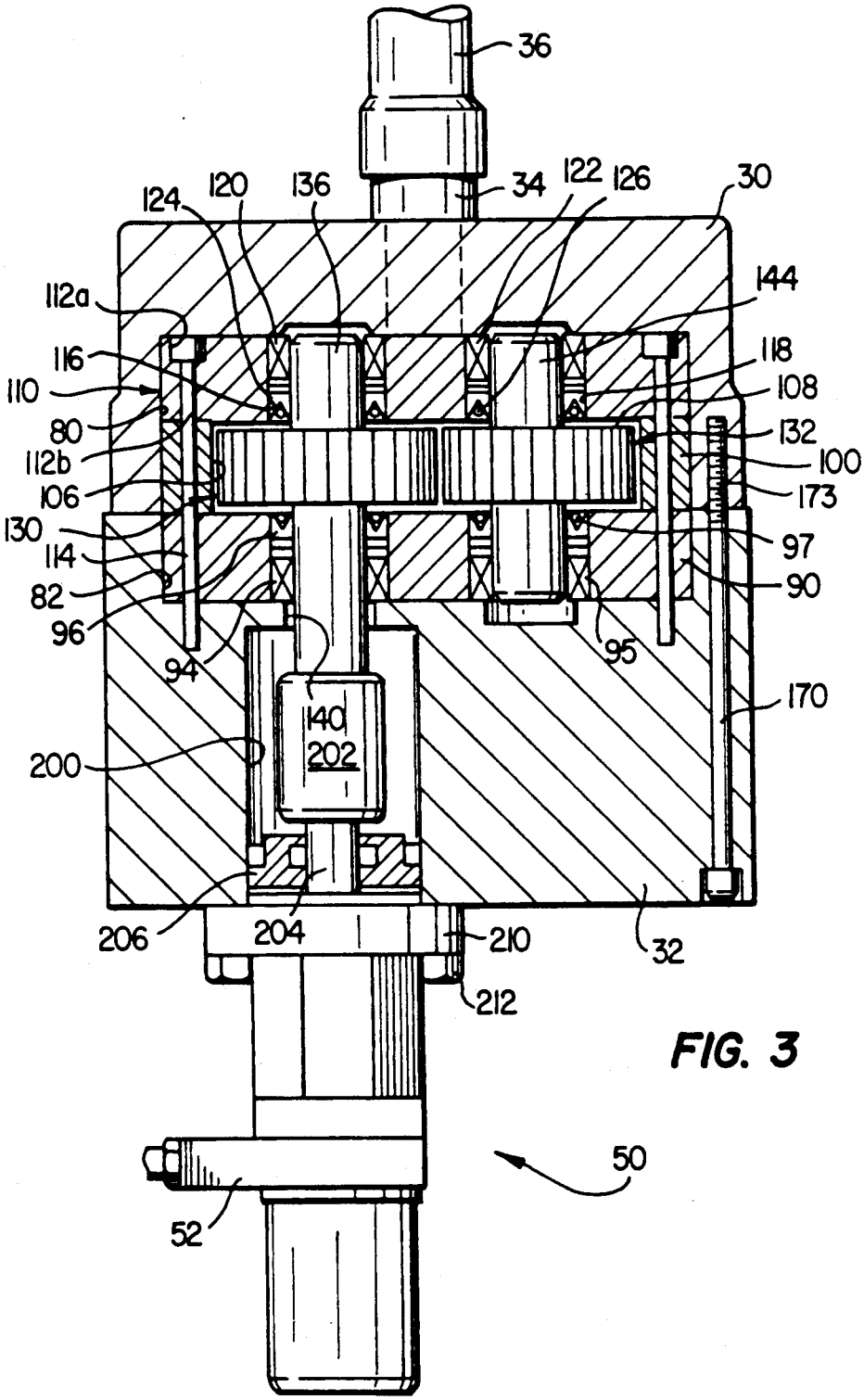
FIG. 3 is a vertical section view thereof taken along line 3—3 of FIG. 1.

FIG. 2 illustrates the structure of FIG. 1 in an exploded view to show the internal components, and FIG. 3 is a section view taken along lines 3—3 of FIG. 1. Referring to FIG. 2 in conjunction with FIG. 3, upper housing 30 has a machined-out cavity 80 which, when assembled to lower housing 32, is aligned with a cavity 82 formed in the lower housing. Housing 32 has within it a plurality of threaded holes 84 formed about the inner circumference of the base of cavity 82. A process chamber bottom plate 90 fits within cavity 82 and has a plurality of holes 91 therethrough which correspond to threaded holes 84. Process chamber bottom plate 90 also has a pair of holes 92 and 93 therethrough which receive therein bearings 94 and 95 and seals 96 and 97, respectively. Referring to FIG. 2 in conjunction with FIG. 3, a process chamber sidewall plate 100 is positioned over process chamber bottom plate 90. Plate 100 has a plurality of holes 102 therethrough which correspond to holes 91 in bottom plate 90. Plate 100 has a central opening 106 formed therethrough, which will be described in greater detail hereinafter, to define a process chamber 108.

A process chamber top plate 110 is mounted over sidewall plate 100 and has an outer shape which corresponds to that of plates 100 and 90. Top plate 110 has a plurality of holes 112 formed therethrough which correspond to holes 102 and holes 92 of plates 100 and 90, respectively. As can be seen in FIG. 3, holes 112 in top plate 110 have a bored upper portion **112*a* of a greater diameter than lower portion 112*b* to accommodate the bolt head of bolts 114 which are used to assemble top plate 110, plate 100 and bottom plate 90 in the manner shown. Specifically, bolts 114 are threaded into threaded holes 84 and lower housing 32 to secure the three plates in position. Referring again to top plate 110, bores 116 and 118 are formed therethrough and receive bearings 120 and 122, respectively. As shown in FIG. 3, seals 124 and 126 are fitted in bores 116 and 118**, respectively, adjacent the lower face thereof.

As can be seen in FIGS. 2 and 3, a pair of process gears 130 and 132 are assembled between and through top plate 110 and bottom plate 90. Specifically, drive process gear 130 includes a drive gear segment 134 attached for rotation with drive shaft 136. The lower portion of drive shaft 136 is journaled in bearing 94 and extends therethrough and through an opening 140 in the lower housing 32. The upper portion of shaft 136 is journaled in bearing 120.

A second, driven, process gear 132 includes a gear segment 142 fixed for rotation with shaft 144. The lower end of shaft 144 is journaled in bearing 95, fitted in bottom plate 90, and the upper portion of the shaft is journaled for rotation in bearing 122. Top plate 110 also has an inlet aperture 160 therethrough and an exhaust aperture 162.

Referring to FIGS. 2 and 3, upper housing 30 is mounted to lower housing 32 using bolts 170 which pass through holes 172 (FIG. 2) in the lower housing. The upper housing 30 has a plurality of corresponding holes 173 which are threaded to receive the threaded ends of bolts 170 (FIG. 3). When upper housing 30 is assembled with a lower housing 32, cavities 80 and 82 define a chamber in which top plate 110, plate 100 and bottom plate 90 are positioned. Process chamber 108 is likewise formed by sealing opening 106 with plates 110 and 90 as shown in FIGS. 2 and 3.

Inlet 34 in upper housing 30 communicates through the top wall of upper housing 30 and is aligned for fluid communication with inlet 160. Similarly, exhaust 162 is aligned with an opening through the upper housing 30 which communicates to exhaust fitting 40. The connection of torque motor assembly 50 to drive process gear 130 is shown in FIG. 3. Specifically, lower housing 32 has a enlarged bore 200 overlying smaller aperture 140. The lower end of shaft 136 extends through aperture 140 and into enlarged bore 200 and is connected by coupling 202 to torque motor shaft 204. A seal 206 is positioned around shaft 204 within bore 200. Torque motor assembly 50 has a mounting collar 210 which is attached by bolts 212 to lower housing 32.

Figure 4:
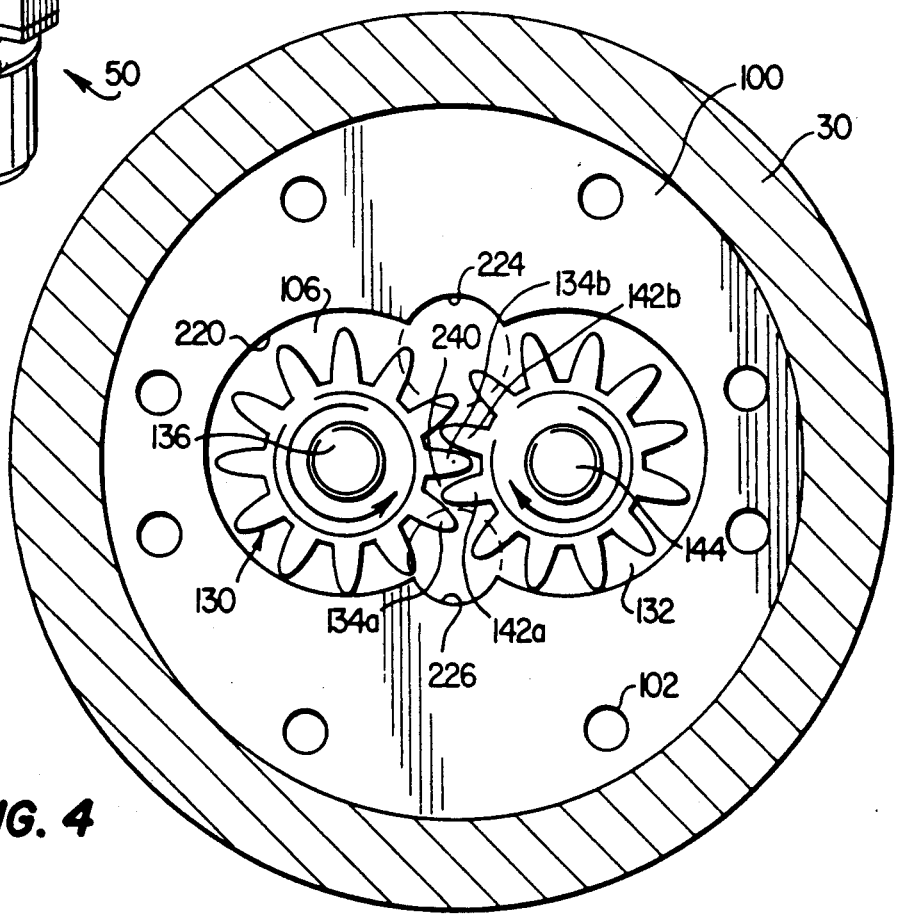
FIG. 4 is a horizontal section thereof taken along lines 4—4 of FIG. 1.

The relationship between process gears 130 and 132 and between such gears and central opening 106 in plate 100 is shown in FIG. 4. Specifically, opening 106 in plate 100 has a pair of arcuate walls 220 and 222 which are, in one embodiment, slightly off concentricity with the axis of rotation of process gears 130 and 132, respectively. Arcuate surfaces 220 and 222 are positioned relative to the axis of rotation of the gears in that the distance between those surfaces and the gear teeth is greater adjacent the inlet than adjacent the exhaust. Process chamber 108 is the chamber defined by sealing opening 106 in plate 100 with plates 110 and 90 as shown on FIGS. 2 and 3.

Referring still to FIG. 4, central opening 106 has a surface 224 which defines an area in line with inlet 160 and a surface 226 which defines an area in line with exhaust 162 of top plate 110. It will be understood that while the distance between the gear teeth and the process chamber wall adjacent surface 224 is greater than that between the gear teeth and the process chamber wall adjacent surface 226, the relationship shown in FIG. 4 is significantly exaggerated for purposes of illustration. Specifically, in one embodiment of the invention, the distance between those surfaces and the gear teeth and the process chamber wall adjacent the inlet is on the order of 0.025 in. (0.635 mm) while the distance from the gear teeth outer edge and the process chamber wall adjacent the exhaust is on the order of 0.003 in. (0.076 mm). It will be understood that these clearances can be changed according to the materials being processed.

A significant feature of the present invention is found in the relationship between process gears 130 and 132. As seen in FIG. 4, process gear 130 rotates in a counterclockwise direction and gear 132 rotates in a clockwise direction as seen in FIG. 4. However, unlike a standard gear pump, a total lash of from 0.0015 in. (0.038 mm) to 0.015 in. (0.38 mm) is provided between the gear teeth at the point of intermesh. In other words, the gear teeth are designed such that they do not incorporate a zero or near zero lash as is the case in ordinary gear pumps. This 0.0015 in. lash provides for a possible clearance on either side of any tooth of 0.00075 in. (0.011 mm) at the point of intermesh of the gear teeth. If the processor is used in stages, a first stage processor may be set such that this lash is 0.030 to 0.050 in. (0.762 to 1.27 mm), followed by treating the material by passing it through a processor having a smaller lash.

Thus, in the present invention, material continuously exists between the leading edge of teeth **134*a* and 134*b* and the trailing edge of teeth 142*a* and 142*b* of process gears 130 and 132, respectively. Moreover, material will therefore be trapped in the areas designated by numeral 240 (FIG. 4). This is in contrast to the operation of the normal gear pump wherein the leading surface of teeth 134*a* and 134*b* are in surface-to-surface contact with the trailing surfaces of teeth 142*a* and 142*b*, respectively. Further, the ordinary gear pump is not designed to allow material to flow through the mesh area designated by numeral 240 as in the present invention. Thus, in the present invention, as the material passes through the intermesh zone designated by numeral 240**, it is subjected to extreme pressures, localized cavitation, heating and shear which do not occur in any other pumping or processing system. This is accomplished even though, and in part because of, the relatively slow rotation of the process gears.

The clearance between the process gears is accomplished in a number of ways. First, the rotation speed of the present invention is relatively slow when compared to the speed of operation of a normal gear pump. In one embodiment of the invention, the rotation is less than 200 rpm. Further, the material being processed is such that its viscosity is sufficient to maintain its position between the leading edges of the drive gear teeth and the trailing edges of the driven gear teeth to create a material flow path between the intermeshed gears at all times during rotation. As a result, a viscous coupling effect is created such that the clearance between the gears permits viscous fluid to be retained therebetween and subjected to the pressures created in the intermesh region. It has been found that the clearance or lash between the gear teeth should be varied according to the viscosity of the material. Where materials of higher viscosities are processed, greater lash is required. Alternatively, where materials of lesser viscosities are processed, then smaller lash clearances are required.

In the primary embodiments, rotation of the drive gear is at a relatively slow rate, on the order of 200 rpm or less, such that the material is not forced out of the intermesh region, nor subjected to centripetal forces, but rather is carried therethrough to be subjected to the extreme pressures, shear and cavitation which create the process results.

Testing of the device of the present invention has demonstrated unexpected physical alterations in the materials processed. Specifically, it has been found that liquid materials, such as chemicals used in the production of urethane and silicone polymers, that tend to solidify or form semi-solid materials or aggregate masses during storage, can be converted back to a homogeneous liquid state by processing through the present invention. Paints, varnishes and other surface coatings that tend to separate or solidify during storage are also favorably affected by the apparatus. Moreover, solid materials such as organic wastes from food products and the like can be reduced to a liquid form by the ability of the processor to disrupt the cellular walls of these organic materials. Thus, the invention can also be applied to the reduction of solid organic wastes or the production of liquefied organic fertilizer from organic wastes. This ability to disrupt cellular membranes may also be applied to process biological materials for the extraction of various biochemicals.

It is believed that the beneficial results of the processor is caused by its ability to crush and deform larger solid material components (generally suspended in viscous liquids) to produce smaller particles, and then force these products through a constricted area at high localized velocity where the pressure differentials, localized heating, shear and cavitation effects, causes alteration of the physical structure of the materials. As has been described above, although the invention resembles a conventional gear pump, the clearances at the mesh of the gears, that is, the gear lash, and the speed of operation keep the processor from functioning as a conventional pump. A conventional gear pump relies on the mesh zone of the gears to form a seal between the low and high pressure sides of the pump. In the present invention, the apparatus relies on maintaining a zone at the gear mesh with sufficient clearance to allow material to pass through the gear mesh back to the input side of the apparatus.

As material enters the device through inlet 34, it is carried into the process chamber and between the gear teeth and process chamber sidewall toward the exhaust port. The clearance between the gear teeth and the housing lessens as the material approaches the outlet port, acting to crush any large lumps of material trapped within this space. When the material reaches the exhaust port area, large particles are caught between the teeth of the meshing gears, crushed and returned to the inlet port side through the clearance supply to the inlet side by the defined gear lash. Viscous fluids dynamically behave similarly to the solids, in that they are trapped between the meshing gear teeth and a portion of the material is extruded by pressure through the clearance of the gear mesh back to the input side. As fresh material is introduced to the input side, the material that has been cycled through the gear mesh is finally forced to exit through the exhaust port. Thus, the resident time in the processor is determined by the rate of input.

Care is taken not to drive the device at too high a speed to prevent the inertia of the driven gear from becoming sufficient to allow the drive gear to overcome the viscous coupling effects that are maintaining the clearance between the gears. Thus, contact between the drive gear and the driven gear are avoided so that a seal therebetween is not created. If this were to occur, then the apparatus would behave like a conventional gear pump, discharging the material from the exhaust port without being processed through the gear meshing zone. In the present design, speeds of approximately 200 rpm or less have been proven to be suitable.

It will also be understood that methods to ensure the integrity of the gap in the gear mesh at higher speeds could be implemented, such as by driving both of the shafts externally with two externally-meshed gears that have less gear lash than the internal gears. This approach would allow the internal gear clearance to be maintained at any speed range. Multiple stages of processing can also be implemented with each stage designed for finer processing clearances, or several stages using the same dimensions can be used to increase overall resident treatment time. Similarly, several gears in the same housing could be used for series processing.

Figure 5:
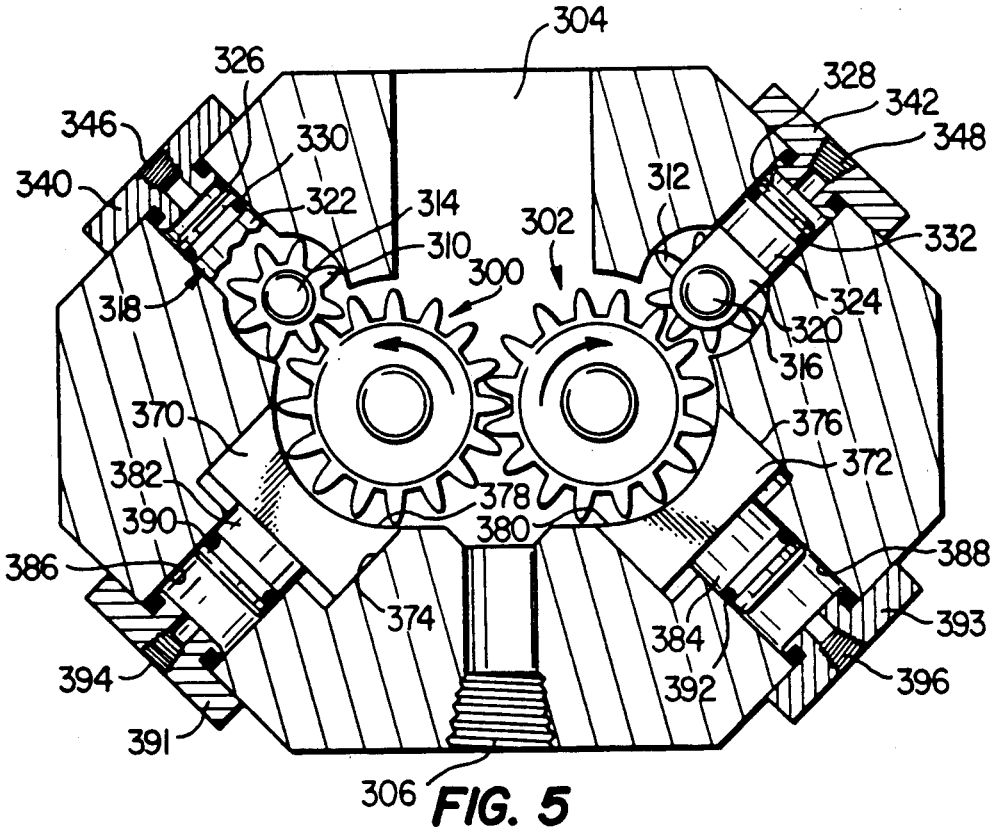
FIG. 5 is a horizontal section of a first alternative embodiment of the processing apparatus shown in FIG. 1.

Other embodiments using variants of this basic design can be used to improve the effectiveness of the process. FIG. 5 illustrates a variation of the basic design wherein a pair of intermeshing process gears 300 and 302, which correspond to the process gears 130 and 132 in the embodiment of FIGS. 1 through 4, are mounted for rotation in a process chamber having an inlet 304 and an exhaust 306. In this embodiment, a pair of spur gears 310 and 312 are mounted for rotation on shafts 314 and 316, respectively, which are journaled in a U-shaped carrier 318 and 320, respectively, mounted to pistons 322 and 324. Pistons 322 and 324 translate in cylinders 326 and 328 and a fluid-tight seal is formed between the pistons and the cylinders by appropriate O-rings 330 and 332, respectively. The cylinders 326 and 328 have a top opening which is closed off by a cap 340 and 342, respectively. Each cap has a fitting 346 and 348, respectively, to permit the introduction of hydraulic fluid within the cylinder above pistons 322 and 324. As can be seen in FIG. 5, the position of spur gears 310 and 312 relative to process gears 300 and 302 may be adjusted by the introduction of fluid within cylinders 326 and 328. Rotation of process gears 300 and 302 are in the direction of the arrows illustrated, process gear 300 turning in a counterclockwise direction and gear 302 turning in a clockwise direction as seen in FIG. 5. The clearances between gears 310 and 312 and process gears 300 and 302 are sufficient to permit the fluid being processed to pass therebetween while at the same time allowing for crushing and mixing of material which passes therebetween. Thus, material being loaded into the processor is first treated by the crushing and mixing effect provided between spur gears 310 and 312 and process gears 300 and 302. This process action, of course, takes place prior to the recycling of the material through the mesh area between gears 300 and 302.

Referring still to FIG. 5, adjustable shoes 370 and 372 are slidably positioned within appropriate cylinders 374 and 376, respectively, and have an arcuate surface 378 and 380, respectively, which forms a portion wall of the process chamber. The wall substantially corresponds to the arc scribed by the outer edge of the teeth of process gears 300 and 302. Shoes 370 and 372 have a piston 382 and 384, respectively, attached to the face opposite surfaces 378 and 380, such piston moving in a cylinder 386 and 388, respectively. O-rings 390 and 392 ride with pistons 382 and 384 and form a seal between the pistons and cylinders 386 and 388. Cylinders 386 and 388 are closed by caps 391 and 393 having an opening 394 and 396, respectively, through which hydraulic fluid may be loaded to adjust the position of shoes 370 and 372 relative to the process gears. By loading fluid into cylinders 386 and 388, the shoes may be made to approach, and indeed even provide zero clearance between the arcuate surfaces defined by the shoes and the process gears. While the preferred embodiment is illustrated as using hydraulically actuated spur gears 310 and 312, and adjustable shoes 370 and 372, it will be understood that other means, such as the use of springs or pneumatically controlled pistons can be used in lieu of hydraulically controlled pistons, to position such components.

In the embodiments shown in FIGS. 1 through 4, it can be seen that there is a possibility for some of the material to exit the device prior to movement through the mesh area and therefore not be completely processed. This limitation can be overcome by passing the materials through the processor several times or by linking several processing stages in series. In this arrangement, the clearances between the teeth of the process gears and the process chamber can be consecutively reduced so as to result in finer and finer processing. Similarly, the lash between one process gear and the other may be reduced to effect additional breakdown of the material.

Figure 6:
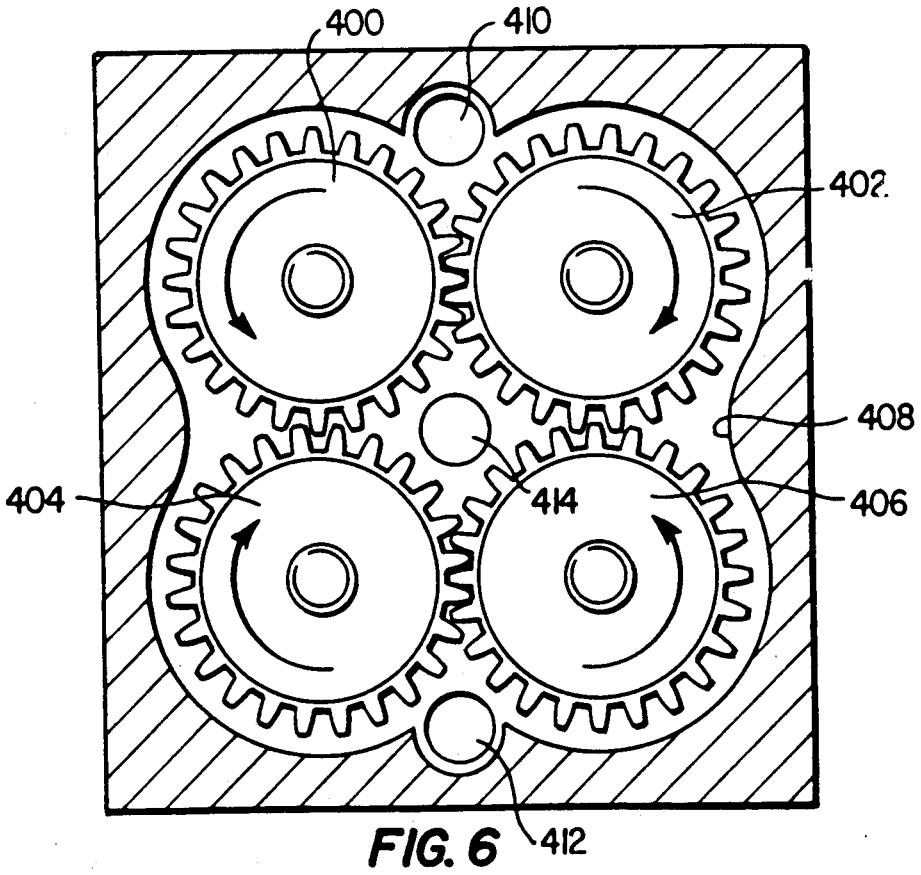
FIG. 6 is a horizontal section of a second alternative embodiment of the processing apparatus shown in FIG. 1.

In yet another alternative embodiment, the design variation shown in FIG. 6 may be used wherein four gears are incorporated to ensure that all material exiting the processor has made at least one pass through the mesh zone between the process gears. In this embodiment, a first gear pair 400 and 402 rotate in a counterclockwise and clockwise direction, respectively, and a second gear pair 404 and 406 rotate in a clockwise and counterclockwise direction, respectively, as seen in the figure. The gears are positioned for rotation in a process chamber 408. Two inlets 410 and 412 are provided and a single exhaust 414 is positioned to communicate with the area in between all four gears. In this arrangement, gears 400 and 402 are positioned as closely together as possible to produce a tight seal in their mesh area. Similarly, gears 404 and 406 are configured to produce a tight seal. The two gear sets are then positioned to intermesh with the mesh zones between gears 400 and 404 and between gears 402 and 406 having a slight clearance therebetween similar to that described with respect to the process gears 130 and 132 in the embodiment of FIGS. 1 through 4.

Material is introduced into inlet ports 410 and 412 where it is pumped by the action of the gears to the mesh zones with the slight clearance, that is, the mesh zones between gears 400 and 404 and between gears 402 and 406. The material is forced through these clearances in the mesh zone by the pressures produced from the pumping effect of the gear sets. It is through these mesh zones that the material is subjected to a shearing and extruding process which has been described with respect to the embodiments of FIG. 1 through 4. As the material is forced through this constricted intermeshing area at high localized velocity (although the rotational speed of the gears is relatively low, on the order of 200 rpm or less,) high pressure, localized heating, shear and cavitation effect causes an alteration of the physical structure of the materials. Then, the material exits the processor through exit port 414. This design ensures that all material entering the apparatus has been processed through a narrow clearance mesh area before it can exit. As in the other embodiments, this method can also be configured to provide for several stages to be connected together in series, if desired, to allow repetitive processing.

Although not illustrated in the drawing, it will be understood that the clearances between the gear teeth and the wall of the process chamber adjacent the inlets may be slightly greater than that between the gear teeth and the process chamber adjacent the narrow clearance mesh area leading to the exit prot. This facilitates further breakdown of material as it passes through the processor.

By reversing the rotational direction of each of the gears 400, 402, 404 and 406, port 414 can be used as an inlet port and ports 410 and 412 can be used as an outlet port if desired. In this case, similar processing of the material is achieved.

Therefore, the present invention discloses an apparatus for processing materials to improve the rheological and material properties. Additionally, the invention may be used to liquify suitable solids, reduce aggregates, or to mix components. In the primary embodiment, the processor includes a housing which defines a process chamber having an inlet for introducing material therein and an outlet for discharging material. Intermeshing gears are rotationally positioned in the process chamber and define an area of intermesh in the flow path between the inlet and the outlet of the process chamber. One or both of the intermeshing gears are rotated by a power source, and the mesh between the gears is such that a clearance exists therebetween during rotation. This clearance provides that material is constantly positioned between the leading edge of the drive and the trailing of the driven gear. Further, the material becomes trapped in the intermesh zone where it is subjected to extreme pressures, localized heating, cavitation effects and shearing which result in a processing of the material. For example, it has been found that materials such as paints, coatings and sealants which have become unusable because they have been stored beyond their acceptable shelf life, can be cycled through the apparatus of the present invention and be restored to their original state, or even improved. As has been described, other variations of the invention have been disclosed which assure the passage of the material through at least one intermesh zone to reprocess the material. Moreover, given sufficiently low input, with the relatively slow rotation of the process gears, the material will tend to cycle more than one time through the intermesh zone and thereby be subjected to the reprocessing effect repeatedly.

Although preferred embodiments of the invention have been described in the foregoing detailed description and illustrated in the accompanying drawings, it will be understood that the invention is not limited to the embodiments disclosed, but is capable of numerous rearrangements, modifications, and substitutions of parts and elements without departing from the spirit of the invention. The present invention is therefore intended to encompass such rearrangements, modifications and substitutions of parts and elements that fall within the scope of the invention.

I claim:

1. A material processor comprising:

a housing defining a process chamber having an inlet for introducing material therein and an outlet for discharging material therefrom, a drive process gear and a driven process gear in intermeshing relation and rotatable in said process chamber, said area of intermesh being in a flow path between the inlet and outlet in the process chamber, said drive and driven process gears designed with a clearance therebetween such that the mesh between said gears during selected rotational speeds permits said driven gear to be forced ahead of and out of contact with said drive gear by material therebetween, thereby allowing material to flow from the discharge side to the inlet side of said gears through the intermesh, and a power source for rotating said drive gear at one of said rotational speeds.

2. The material processor according to claim 1 wherein said gears are rotated such that material is introduced into the inlet and flows around the gears, between the gears and the corresponding sidewall of the process chamber, and recirculates through the intermesh area of the gears.

3. The material processor according to claim 1 further comprising a spur gear supported within the housing and positioned in intermeshing relation with one or more of the gears to form an intermeshing zone, said spur gear being positioned adjacent the inlet to the process chamber and said intermeshing zone being in the flow path of the material being processed.

4. A material processor comprising:

a housing defining a process chamber having an inlet for introducing material therein and an outlet for discharging material therefrom, a drive process gear and a driven process gear in intermeshing relation and rotatable in said process chamber, said area of intermesh being in a flow path between the inlet and outlet in the process chamber, a power source for rotating said drive gear, and said drive and driven process gears designed with a clearance therebetween such that the mesh between said gears during selected rotational speeds permits said driven gear to be forced ahead of an out of contact with said drive gear by material therebetween, thereby allowing material to flow from the discharge side to the inlet side of said gears through the intermesh, wherein said gears are rotated such that material is introduced into the inlet and flows around the gears, between the gears and the corresponding sidewall of the process chamber, and recirculates through the intermesh area of the gears, and wherein the clearances between the gear teeth and the housing adjacent the inlet are greater than the clearances between the gear teeth and the housing adjacent the outlet.

5. A material processor comprising:

a housing defining a process chamber having an inlet for introducing material therein and an outlet for discharging material therefrom, a drive process gear and a driven process gear in intermeshing relation and rotatable in said process chamber, said area of intermesh being in a flow path between the inlet and outlet in the process chamber, a power source for rotating said drive gear, said drive and driven process gears designed with a clearance therebetween such that the mesh between said gears during selected rotational speeds permits said driven gear to be forced ahead of and out of contact with said drive gear by material therebetween, thereby allowing material to flow from the discharge side to the inlet side of said gears through the intermesh, an adjustable shoe section for forming a portion of the sidewall in the process chamber adjacent to one of the process gears, said adjustable shoe being moveable toward and away from said gear, and control structure for moving said adjustable shoe section toward and away from said gear to control the clearance between said gear and the portion of the process chamber formed by the adjustable shoe section.

6. The material processor according to claim 5 wherein said control structure comprises hydraulic control of the shoe relative to the process gears.

7. A material processor comprising:

a housing defining a process chamber having an inlet for introducing material therein and an outlet for discharging material therefrom, a drive process gear and a driven process gear in intermeshing relation and rotatable in said process chamber, said area of intermesh being in a flow path between the inlet and outlet in the process chamber, a power source for rotating said drive gear, said drive and driven process gears designed with a clearance therebetween such that the mesh between said gears during selected rotational speeds permits said driven gear to be forced ahead of and out of contact with said drive gear by material therebetween, thereby allowing material to flow from the discharge side to the inlet side of said gears through the intermesh, a spur gear supported within the housing and positioned in intermeshing relation with one or more of the gears to form an intermeshing zone, said spur gear being positioned adjacent the inlet to the process chamber and said intermeshing zone being in the flow path of the material being processed, and control structure for adjusting the position of the spur gear in relation to one of the process gears.

8. The material processor according to claim 7 further comprising:

control means for permitting such spur gear to move away from the process gear as an obstruction in the material being processed passes therebetween.

9. The material processor according to claim 8 wherein said spur gear is hydraulically actuated.

10. A material processor comprising:

a housing defining a process chamber having one or more inlets for introducing material therein and at least one outlet for discharging material therefrom, two sets of intermeshing gear pairs rotatable in said process chamber, one of each pair of gears being a driven gear and one being a drive gear, each pair of gears having a tight mesh therebetween with one of said gears in each pair being in loose mesh engagement with one of the gears in the other pair, the inlet being separated from the outlet by at least one loose mesh engagement and one tight mesh engagement between said gears, said loose mesh engagement permitting said driven gear to be forced ahead of and out of contact with said drive gear by material therebetween thereby allowing material to flow from the discharge side of the inlet side of said gears through the loose mesh to the inlet side for processing said material, and a power source for rotating said drive gears to drive said gear pairs to pump said material from the inlets through the tight mesh of said gear pairs.

11. A process system comprising;

a gear assembly for rotating in a process chamber, the assembly having at least one pair of process gears driven in intermeshing operation, one said gear being the drive gear and the other the driven gear, an inlet for delivering material to the process chamber and an exhaust for discharging material therefrom, said drive and driven process gears designed with a clearance therebetween such that the mesh between said gears during selected rotational speeds permits a clearance therebetween such that the driven gear is ahead of and out of continuous contact with the drive gear with a quantity of material positioned therebetween, thereby permitting the flow of material through the intermeshing gears from the exhaust side to the inlet side of said gears subjecting said material to processing, and a power source for driving said drive gear to rotate said gears at said selected rotational speeds.

12. The material processor according to claim 11 wherein said gears are rotated such that material is introduced into the inlet and flows around the gears between the gears and the corresponding sidewall of the process chamber, and recirculates through the intermesh area of the gears.

13. The material processor according to claim 11 further comprising a spur gear supported within the housing and positioned in intermeshing relation with one or more of the gears to form an intermeshing zone, said spur gear being positioned adjacent the inlet to the process chamber and said intermeshing zone being in the flow path of the material being processed.

14. A process system comprising;

a gear assembly for rotating in a process chamber, the assembly having at least one pair of process gears driven in intermeshing operation, one said gear being the drive gear and the other the driven gear, a power source for driving said drive gear, an inlet for delivering material to the process chamber and an exhaust for discharging material therefrom, and said drive and driven process gears designed with a clearance therebetween such that the mesh between said gears during selected rotational speeds permits a clearance therebetween such that the driven gear is ahead of and out of continuous contact with the drive gear with a quantity of material positioned therebetween, thereby permitting the flow of material through the intermeshing gears from the exhaust side to the inlet side of said gears subjecting said material to processing, wherein said gears are rotated such that material is introduced into the inlet and flows around the gears between the gears and the corresponding sidewall of the process chamber, and recirculates through the intermesh area of the gears, and wherein the clearances between the gear teeth and the housing adjacent the inlet are greater than the clearances between the gear teeth and the housing adjacent the outlet.

15. A process system comprising;

a gear assembly for rotating in a process chamber, the assembly having at least one pair of process gears driven in intermeshing operation, one said gear being the drive gear and the other the driven gear, a power source for driving said drive gear, an inlet for delivering material to the process chamber and an exhaust for discharging material therefrom, said drive and driven process gears designed with a clearance therebetween such that the mesh between said gears during selected rotational speeds permits a clearance therebetween such that the driven gear is ahead of and out of continuous contact with the drive gear with a quantity of material positioned therebetween, thereby permitting the flow of material through the intermeshing gears from the exhaust side to the inlet side of said gears subjecting said material to processing, an adjustable shoe section for forming a portion of the sidewall in the process chamber adjacent one of the process gears, said adjustable shoe being moveable toward and away from said gear, and control structure for moving said adjustable shoe section toward and away from said gear to control the clearance between said gear and the portion of the process chamber formed by the adjustable shoe section.

16. The material processor according to claim 15 wherein said control structure includes hydraulic control of the shoe section relative to the process gears.

17. A process system comprising;

a gear assembly for rotating in a process chamber, the assembly having at least one pair of process gears driven in intermeshing operation, one said gear being the drive gear and the other the driven gear, a power source for driving said drive gear, an inlet for delivering material to the process chamber and an exhaust for discharging material therefrom, said drive and driven process gears designed with a clearance therebetween such that the mesh between said gears during selected rotational speeds permits a clearance therebetween such that the driven gear is ahead of and out of continuous contact with the drive gear with a quantity of material positioned therebetween, thereby permitting the flow of material through the intermeshing gears from the exhaust side to the inlet side of said gears subjecting said material to processing, a spur gear supported within the housing and positioned in intermeshing relation with one or more of the gears to form an intermeshing zone, said spur gear being positioned adjacent the inlet to the process chamber and said intermeshing zone being in the flow path of the material being processed, and control structure for adjusting the position of the spur gear in relation to one of the process gears.

18. The material processor according to claim 17 further comprising:

control means for permitting such spur gear to move away from the process gear as an obstruction in the material being processed passes therebetween.

19. The material processor according to claim 18 wherein said spur gear is hydraulically actuated.

20. A process system comprising;

a gear assembly for rotating in a process chamber, the assembly having at least one pair of process gears driven in intermeshing operation, one said gear being the drive gear and the other the driven gear, a power source for driving said drive gear, an inlet for delivering material to the process chamber and an exhaust for discharging material therefrom, and said drive and driven process gears designed with a clearance therebetween such that the mesh between said gears during selected rotational speeds permits a clearance therebetween such that the driven gear is ahead of and out of continuous contact with the drive gear with a quantity of material positioned therebetween, thereby permitting the flow of material through the intermeshing gears from the exhaust side to the inlet side of said gears subjecting said material to processing, wherein said driven gear is power driven such that is leads said drive gear allowing a clearance therebetween.

21. A material processor comprising:

a housing defining a process chamber having an inlet for introducing material therein and an outlet for discharging material therefrom, a pair of intermeshing process gears rotatable in said process chamber and designed such that a clearance can exist therebetween, a power source for rotating said gears at a selected rotational speed such that a clearance exists therebetween, gears not making contact in the intermeshing relation allowing recirculation of the materials being processed past said gears from the discharge side of said gears to the inlet side.

22. The material processor according to claim 21 wherein said gears are rotated such that material is introduced into the inlet and flows around the gears between the gears and the corresponding sidewall of the process chamber, and recirculates through the intermesh area of the gears.

23. The material processor according to claim 21 further comprising a spur gear supported within the housing and positioned in intermeshing relation with one or more of the gears to form an intermeshing zone, said spur gear being positioned adjacent the inlet to the process chamber and said intermeshing zone being in the flow path of the material being processed.

24. A material processor comprising:

a housing defining a process chamber having an inlet for introducing material therein and an outlet for discharging material therefrom, a pair of intermeshing process gears rotatable in said process chamber and designed such that a clearance can exist therebetween, and a power source for rotating said gears such that a clearance exists therebetween, gears not making contact in the intermeshing relation allowing recirculation of the materials being processed past said gears, wherein said gears are rotated such that material is introduced into the inlet and flows around the gears between the gears and the corresponding sidewall of the process chamber, and recirculates through the intermesh area of the gears, and wherein the clearances between the gear teeth and the housing adjacent the inlet are greater than the clearances between the gear teeth and the housing adjacent the outlet.

25. A material processor comprising:

a housing defining a process chamber having an inlet for introducing material therein and an outlet for discharging material therefrom, a pair of intermeshing process gears rotatable in said process chamber and designed such that a clearance can exist therebetween, a power source for rotating said gears such that a clearance exists therebetween, gears not making contact in the intermeshing relation allowing recirculation of the materials being processed past said gears, an adjustable shoe section for forming a portion of the sidewall in the process chamber adjacent one of the process gears, said adjustable shoe being moveable toward and away from said gear, and control structure for moving said adjustable shoe section toward and away from said gear to control the clearance between said gear and the portion of the process chamber formed by the adjustable shoe section.

26. The material processor according to claim 25 wherein said control structure includes hydraulic control of the shoe sections relative to the process gears.

27. A material processor comprising:

a housing defining a process chamber having an inlet for introducing material therein and an outlet for discharging material therefrom, a pair of intermeshing process gears rotatable in said process chamber and designed such that a clearance can exist therebetween, a power source for rotating said gears such that a clearance exists therebetween, gears not making contact in the intermeshing relation allowing recirculation of the materials being processed past said gears, a spur gear supported within the housing and positioned in intermeshing relation with one or more of the gears to form an intermeshing zone, said spur gear being positioned adjacent the inlet to the process chamber and said intermeshing zone being in the flow path of the material being processed, and control structure for adjusting the position of the spur gear in relation to one of the process gears.

28. The material processor according to claim 27 further comprising:

control means for permitting such spur gear to move away from the process gear as an obstruction in the material being processed passes therebetween.

29. The material processor according to claim 28 wherein said spur gear is hydraulically actuated.

* * * * *